United States Patent [19]

Dunn

[11] Patent Number: 4,754,893

[45] Date of Patent: Jul. 5, 1988

[54] CONTAINER FOR MIXING AND STORAGE

[75] Inventor: Lyman D. Dunn, Chicago, Ill.

[73] Assignee: Zantek, Inc., Chicago, Ill.

[21] Appl. No.: 57,519

[22] Filed: Jun. 1, 1987

Related U.S. Application Data

[63] Continuation of Ser. No. 840,042, Mar. 17, 1986, abandoned.

[51] Int. Cl.[4] ..... B65D 7/00

[52] U.S. Cl. ..... 220/94 R; 220/95; 220/1 M; 294/31.2; 294/34

[58] Field of Search ..... 220/5 R, 1 M, 9 HR, 220/95; 294/31.2, 37

[56] References Cited

U.S. PATENT DOCUMENTS

| | | | |
|---|---|---|---|
| 1,022,533 | 4/1912 | Cummings | 294/34 |
| 1,324,015 | 12/1919 | Fitzsimmons | 294/34 |
| 1,336,049 | 4/1920 | Rix | 294/34 |
| 1,429,630 | 9/1922 | Rebideau | 220/1 M |
| 1,516,956 | 11/1924 | Davie | 294/31.2 |
| 1,993,976 | 3/1935 | Nelson | 294/31.2 |
| 3,113,799 | 12/1963 | Budnik | 294/31.2 |
| 3,854,582 | 12/1974 | Martinelli | 206/508 |
| 4,513,875 | 4/1985 | Kuehn, Sr. | 220/5 R X |

*Primary Examiner*—Steven M. Pollard

*Attorney, Agent, or Firm*—Mann, McWilliams, Zummer & Sweeney

[57] ABSTRACT

A container is provided for the mixing and storage of liquid and liquifiable ingredients which, when full, must be carried from place to place. The container has a constricted neck between an upwardly flared brim and a downwardly flared shoulder section to which is attached a vertically slidable handle assembly arranged to conform to the counters of the container when at rest and to maintain the container in a substantially upright orientation when full to avoid spillage of the contents.

3 Claims, 1 Drawing Sheet

CONTAINER FOR MIXING AND STORAGE

BACKGROUND OF THE INVENTION

1. Field of the Invention

This invention relates to the class of containers used in mixing and storing liquid and liquifiable ingredients for the preparation of edible products, such as that known typically as soft serve ice cream. Specifically, the field of this invention includes various handle arrangements for carrying such containers.

2. Description of the Prior Art

The following U.S. patents are considered relevant prior art by the applicant in the field of liquid containers and their handles.

U.S. Pat. No. 1,247,355 to Wildberger illustrates a removable milk can carrier consisting of a semicircular neck portion and a semicircular bail portion joined at right angles and used to grip the neck of a milk can. Since the handle is angled from the ring portion, it cannot conform to the lower portion of the neck of the cannister, nor is it meant to do so.

U.S. Pat. No. 1,352,173 to Campbell discloses a unitary construction removable milk bottle carrier comprising a closed loop with the two ends of the loop bent toward each other.

U.S. Pat. No. 2,160,662 to Jenkins discloses a two-piece bottle carrier comprising an interlocking ring and an attached bail, with the bail adapted to hinge on the ring to swing from full vertical carrying portion to dependent position to lie close to the neck of the bottle.

U.S. Pat. No. 2,806,731 discloses a milk bottle carrier formed of a unitary length of resilient wire and including a hook adapted to engage the neck of a milk bottle at one end of the wire and a handle at the other hand.

None of the above listed prior art handle container arrangements teaches the use of a permanently attached, slidably mounted handle which can be positioned to allow one handed carriage of a heavily filled milk can like container, while substantially reducing the likelihood of spillage.

SUMMARY OF THE INVENTION

The present invention provides a unitary, sanitary container for the mixing and storage of food products and a permanently attached, vertically slidable handle arranged so that the container may be easily carried by one hand. The container is also provided with a one-piece molded lid which is fitted to a horizontal top rim adapted to support a mixer having a vertical shaft and blade assembly to prepare the liquid contents for use.

The handle assembly, when fitted to the container neck may not be removed from the container without destruction of either the container, the handle or both. At rest, the handle conforms to the shape of the container, resting on the shoulder of the container below the neck. When the container is filled to the desired level with liquid and liquifiable contents, the cannister may be carried by the handle, which then slides up the neck of the container and provides for convenient one hand carriage of the full container with minimum danger of content spillage.

DESCRIPTION OF THE DRAWING FIGURES

DETAILED DESCRIPTION OF THE PREFERRED EMBODIMENT

Figure 1:
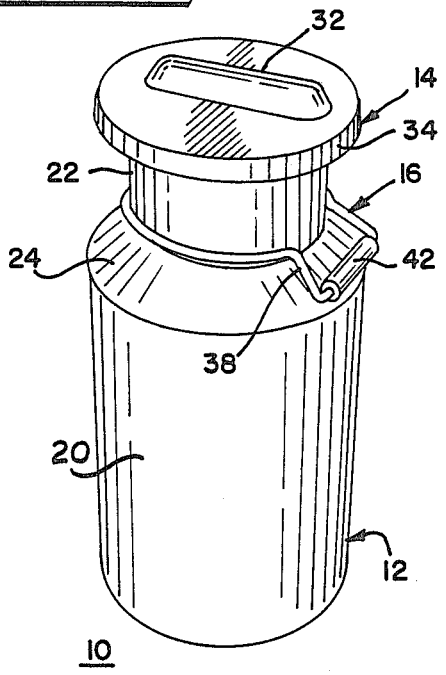
FIG. 1 is a general perspective view of the mixing and storage container embodying applicant's invention.
Figure 2:
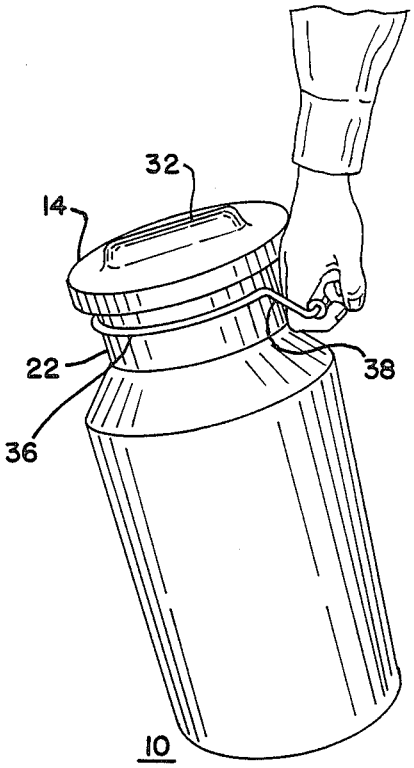
FIG. 2 is a perspective view of the container of FIG. 1 being carried by its vertically slidable handle.

The preferred embodiment of applicant's invention is generally indicated by reference character 10 in FIGS. 1 and 2. The container embodying applicant's invention includes container body 12, container lid 14 and handle 16. Body 12 is of unitary construction, formed of circular base 18 and upright cylindrical section 20. The upper portion of body 12 is constricted to form neck section 22 between shoulder 24 and flared flange 26. Lid 14 is of molded unitary construction, designed to fit snugly to rim 30 at the top of flared flange 26. Lid 14 includes molded handle 32 and dependent collar 34 which fits snugly around rim 30.

Figure 4:
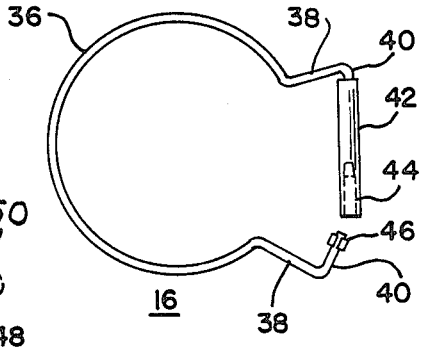
FIG. 4 is a top plan view of the partially assembled handle of the mixing and storage container.

Handle 16, shown partially assembled in FIG. 4 includes ring portion 36, handle extensions 38 and prongs 40. Also provided is handle rod 42 which may be formed of nylon or other suitable plastic material. Cylindrical handle rod 42 includes end sockets 44 (one of which is shown in phantom) to receive prongs 40. Prongs 40 may be pinched to compressibly and outwardly deform the prongs to provide tabs 46 to secure the ends of handle 16 in sockets 44 and to prevent rotation of the handle rod 42 relative to handle ring 36.

When the handle 16 is assembled in the above fashion by fitting prongs 40 in sockets 44, after first spreading the handle ring portion 36 and fitting it about the neck 22, the handle ring portion 36 is slightly larger in inside diameter than the outside diameter of neck 22. In this assembled configuration, handle 16 is free to rotate about neck 22 three hundred and sixty degrees thereabout, and to slide lengthwise of neck 22, and thus, when the container is in the position of FIG. 1, vertically between shoulder 24 and flared flange 26.

In the storage or retracted position of handle 16, the handle ring 36 is resting on the top of shoulder 24, and handle extensions 38 and handle rod 42 are resting on shoulder 24, as shown in FIG. 1. In this position, the handle 16 nests on the shoulder 24 and is safely out of the way of people and equipment passing by the container.

When the container is carried, as shown in FIG. 2, handle 16 is grasped at rod 42, lifting ring 36 up neck 22 to abut the bottom of flared flange 26, whereby handle 16 is disposed in its extended position. In this position, rod 42 is spaced comfortably from flared flange 26, neck 22 and shoulder 24, as shown in FIG. 3.

Figure 3:
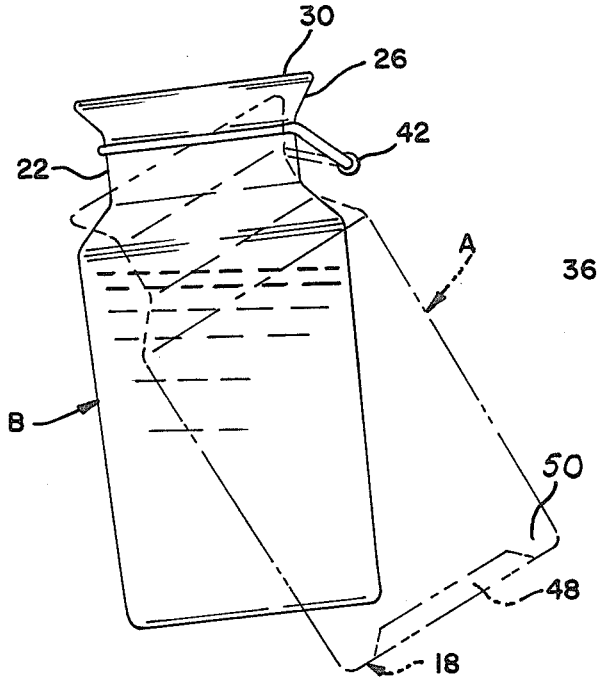
FIG. 3 is a side elevational view of the mixing and storage container without its accompanying lid, in full and empty hand carried orientations.

FIG. 3 illustrates the container embodying the present invention as it may be carried from place to place without lid 14. Position A, shown in phantom, illustrates the approximate attitude of the empty container when carried by handle 16. When the container is filled to the desired mixing level with ingredients and then carried by handle 16, the container's attitude approximates that shown in position B of FIG. 3, since the added weight of the ingredients lowers the unit's center of gravity and rotates the unit downward about handle rod 42. In this position, the container's liquid contents filled to the maximum mixing level will not tend to spill from the opening of the container. This configuration facilitates easy carriage of the container full of mixed ingredients from the location at which the ingredients are poured and mixed to a soft-serve dispenser where the ingredients are poured from the container into the dispenser. An external outer recess 48 is provided at base 18 of the container. Recess 48 is shown in phantom in position A of FIG. 3. Recess 48 is provided as a supplementary handle for grasping the base 18 of the container when pouring the ingredients into the dispenser. Recess 48 is also sized to accommodate handle 32 of lid 14 so that these containers may be stacked for storage. Recess 48 also provides an internal contour 50 at the base of the container to promote more efficient mixing of ingredients through vertical mixing in addition to horizontal rotary mixing in that region.

While the invention has been described in connection with a preferred embodiment, it will be understood that it is not intended to limit the invention thereto, but is intended to cover all modifications and alternative constructions falling within the spirit and scope of the invention as expressed in the appended claims.

What is claimed is:

1. A container arrangement for the mixing and storage of liquid and liquifiable ingredients, said container arrangement comprising:

a container body defining:

a generally cylindrical lower section, a shoulder section at the top of, and centered on, said lower cylindrical section, said shoulder section tapering upwardly and inwardly of said container body uniformly three hundred sixty degrees thereabout, a substantially cylindrical neck section upstanding heightwise from and centered on said shoulder section and defining an upstanding upper end spaced above said shoulder section, and an outwardly flared annular flange adjacent and centered on said upper end of said neck section and tapering upwardly and outwardly of said container body uniformly three hundred and sixty degrees thereabout, said container body defining a chamber for receiving and containing the ingredients and said neck section defining the container body opening to said container body chamber, with said flange being in circumambient relation about said body opening of said neck section, and a handle for lifting and carrying said container body, said handle comprising:

a ring portion mounted on said container body neck section in close fitting slidable relation thereto, rotationally of said neck section and heightwise of said neck section, for being mounted on said container body neck section for rotational movement three hundred sixty degrees thereabout, and for sliding movement longitudinally of said neck section, said handle ring portion at each end of same defining a substantially rectilinear extension, with said extensions respectively projecting generally outwardly of said handle ring portion, and a hand grip handle member connected between said ring portion extensions for securing said handle on said container body, said handle extensions being inclined downwardly of said container body in substantial conformity with the taper of said container body shoulder section for nesting relation of said handle extensions and handle member with said container body shoulder section when said handle rests under gravity on said container body shoulder section, said handle having retracted relation about said container body neck section in which it is free to rest under gravity against said container body shoulder section, said handle having an extended container body carrying relation about said container body neck section in which its said ring portion abuts against said container body flange and said handle member is disposed spaced from said container shoulder section, said handle extensions being respectively proportioned lengthwise thereof to space said handle member from said container body neck section and flange in said handle extended relation for ready hand gripping thereof to manually carry said container body, whereby, when said container body rests upright on a supporting surface, said handle under gravity is biased to its retracted relation, and when said handle member is grasped for hand carrying of said container body, said handle slides heightwise of said container neck section to its extended container body carrying relation for disposing said handle member spaced from said flange for ready hand gripping of said handle member, of said handle.

2. The container arrangement set forth in claim 1 including:

a container lid fittable on said flange in close fitting relation thereto for closing said container body chamber opening, said lid being proportioned to be spaced from said handle member when said handle is in its said extended relation.

3. The container arrangement set forth in claim 1 wherein:

said lengthwise proportioning of said handle extensions is such that in said retracted relation of said handle, said handle member rests on said container body shoulder section.

* * * * *